United States Patent [19]

Stelk

[11] Patent Number: 5,072,888

[45] Date of Patent: Dec. 17, 1991

[54] SYMMETRICAL PROTECTIVE CAP FOR A ROTARY HAMMER ASSEMBLY FOR A HAMMERMILL

[75] Inventor: John C. Stelk, Bettendorf, Iowa

[73] Assignee: Sivyer Steel Corporation, Bettendorf, Iowa

[21] Appl. No.: 453,622

[22] Filed: Dec. 20, 1989

[51] Int. Cl.[5] ..... B02C 13/28

[52] U.S. Cl. ..... 241/194; 241/197

[58] Field of Search ..... 241/194, 197, 191

[56] References Cited

U.S. PATENT DOCUMENTS

| | | | |
|---|---|---|---|
| 3,727,848 | 4/1973 | Francis | 241/194 |
| 4,000,895 | 1/1977 | Whitney | 241/194 |
| 4,056,232 | 11/1977 | Linnerz et al. | 241/194 |
| 4,222,530 | 9/1980 | Whitney | 241/194 |
| 4,290,545 | 9/1981 | Whitney . | |
| 4,406,415 | 9/1983 | Greer | 241/197 X |
| 4,519,551 | 5/1985 | Ceurvorst | 241/194 |
| 4,613,088 | 9/1986 | Hausler et al. | 241/197 |
| 4,915,310 | 4/1990 | Stelk | 241/197 |
| 5,022,593 | 6/1991 | Stelk | 241/194 |

*Primary Examiner*—Mark Rosenbaum
*Assistant Examiner*—Frances Chin
*Attorney, Agent, or Firm*—Foley & Lardner

[57] ABSTRACT

A protective end cap for a hammermill assembly including a drive shaft having a number of spider assemblies mounted thereon, each spider assembly including a hub having a number of spider arms with the spider arms being aligned with the spider arms on the adjacent spider arm assemblies, a hammer shaft extending through each row of spider arms, a number of hammers mounted on the hammer shaft in the spaces between the spider arms and a protective cap mounted on the exposed portions of the hammer shafts between the spider arms, the caps including flanges on one or both sides for protecting the outer ends of the spider arms.

8 Claims, 1 Drawing Sheet

SYMMETRICAL PROTECTIVE CAP FOR A ROTARY HAMMER ASSEMBLY FOR A HAMMERMILL

BACKGROUND OF THE INVENTION

1. Field of the Invention

This invention relates generally to hammer mills and is particularly concerned with a symmetrical cap for protecting the ends of the spiders which make up the rotor assembly for the hammermill.

2. Description of the Prior Art

Hammermills of the type contemplated herein are used to break up large metal objects such as automobile bodies into small fragments. This is of particular importance in the disposal of old cars and the recovery of usable pieces of scrap metal. These shredders generally include a housing, a rotary hammer assembly mounted for rotary motion in the housing and a drive assembly for rotating the hammer assembly past grate bars which cooperate with the hammers to fragment or shred the metal objects.

The hammer assembly generally includes a number of spiders which are mounted in a spaced relation on a hammermill drive shaft. Each spider includes a number of arms which extend radially outwardly in a spaced relation to provide a support for the hammers. It has been generally known that the life of the spider arms is limited due to the continuous impact of the arms with the fragmentized metal. The life of the spider has been extended by the use of protective caps or tips to protect the arms from impact with the metal fragments as shown in my copending application Serial No. 07/266,119 as well as in U.S. Pat. No. 3,727,848 entitled "Hammermill with Replaceable Spider Arm Tips" issued Apr. 17, 1973; U.S. Pat. No. 4,290,545 entitled "Replaceable Protective Means for End Disc Shredder" issued Sept. 16, 1980; and U.S. Pat. No. 4,222,530 entitled "Method of Attaching a Protective Cap to a Shredder Component" issued Sept. 22, 1981. In all these devices, the cap is mounted on the spider arm and is replaced when worn.

U.S. Pat. No. 4,056,232 entitled "Protective Device for Rotary Hammer Breaker" issued on Nov. 1, 1977, describes a hammerbreaker including a plurality of discs driven upon a rotary shaft and a plurality of rods extending through the discs parallel to the rotor shaft and radially spaced therefrom. A plurality of hammers are pivotably mounted on the rods between the discs. The periphery of the discs are protected by a plurality of shields mounted on the rods between the discs and extending over a part of the periphery of each disc. The shields must be strengthened by webs to prevent breaking off at the ends of the shields.

SUMMARY OF THE INVENTION

The symmetrical cap according to the present invention provides protection for both the spider arm and the hammer shaft. The cap is formed with a hub or body portion that fits between the ends of adjacent spider arms. The cap also includes a circular flange on each side that overlies a portion or all of the outer ends of the spider arms on each side of the hub or body portion of the cap. The caps are locked into position by the hammer shafts. The flanges protect the edges of the spider arms as well as the sidewalls of the spider arms. When the impact area on the cap becomes worn or damaged, the cap can be removed, turned around and replaced on the end of the spider arm.

One of the principal features of the invention is the symmetrical configuration of the caps, which allows the caps to be reversed when worn, thereby extending the life of the cap and reducing the overall cost of the caps.

Another feature of the invention is the ability of the cap to also protect the hammer shafts.

A further feature of the invention is the ability to reverse the direction of rotation of the spider assembly.

Other principal features and advantages of the invention will become apparent to those skilled in the art upon review of the following detailed description, claims and drawings.

Figure 2:
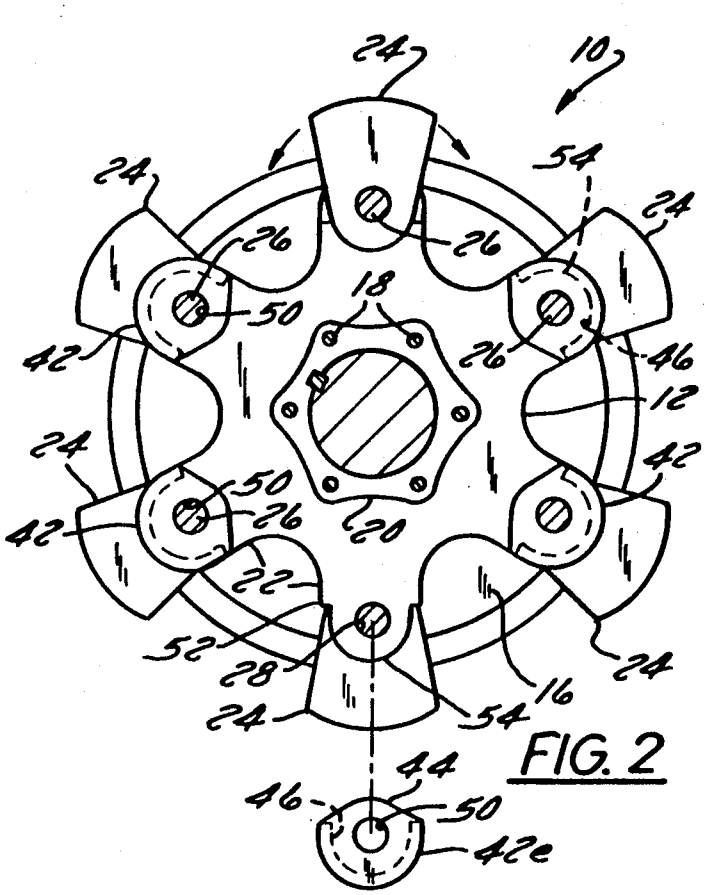
FIG. 2 is an end view of the hammermill rotor showing one of the spider assemblies.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DESCRIPTION OF A PREFERRED EMBODIMENT

The rotary hammermill assembly 10 of the type contemplated herein is formed by a number of spiders 12 which are mounted on and keyed to a shaft 14. The shaft 14 is supported in bearings (not shown) that are structurally mounted in the sidewalls of a hammermill housing. The spiders 12 and end discs 16 are secured together by means of tie rods 18 as is generally understood in the art.

The spiders 12 include a hub 20 and a number of radially extending arms 22. It should be noted that the hubs 20 are wider than the spider arms 22 to provide a space between the arms for hammers 24. The hammers 24 are mounted for rotation on hammer shafts 26 which pass through holes 28 provided in the ends of the spider arms 22. As is generally understood in the art, the hammers 24 are mounted on the rotor assembly at selected locations to provide an even distribution of the hammer weight and a balance of centrifigual forces.

In operation the free swinging hammers 24 rotate with the rotor assembly 10 and coact with grate bars (not shown) that are spaced about the lower part of the orbit of the hammers to break up or fragmentize the metal objects. The pieces of fragmentized material are thrown about the hammermill housing and into the path of motion of the spider arms.

As is generally understood, the hammers 24, and grate bars are formed of specially hardened steel. The spiders 12 and end discs 16 are cast of a softer steel to reduce the possibility of breakage. Although in operation the hammers 24 and grate bars are exposed to the most impact and wear associated with the shredding of the material, the shredded fragments come in constant contact with the front impact area and sidewalls of the spider arms 22 and the exposed portions of the hammer shafts 26.

Figure 4:
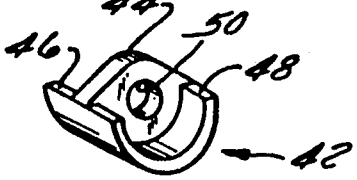
FIG. 4 is a perspective view of one of the caps having flanges on both sides.
Figure 5:
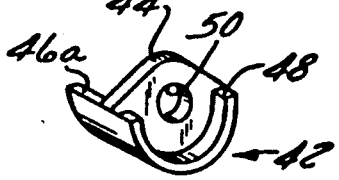
FIG. 5 is a perspective view of one of the caps having a full flange on one side and a half flange on the opposite side.

In accordance with the present invention, each of the spider arms 22 is provided with a symmetrical protective end cap 42 which protects both the impact area on the face of the spider arm 22 as well as the impact area on the sidewalls of the spider arm 22 and the hammer shafts 26. As seen in FIG. 4, each end cap includes a body portion or hub 44 and an arcuate flange 46, 48 on each side of the hub. The hub 44 is provided with a hole 50 which corresponds to the size of the hammer shaft holes 28 in the ends of the spider arms 22. The caps 42 are secured to the spiders by means of the hammer shafts 26 which pass through the holes 50 in the end caps.

Referring to FIG. 2, it should be noted that each of the spider arms 22 is provided with a reduced diameter tip 54 which is recessed slightly from the outer surface 52 of the spider arm. The curvature of the flanges 46 and 48 corresponds to the reduced diameter curvature of the tip 54 in order to provide a smooth transition from the surface 52 of the spider arm to the outer surface of the flanges 46 and 48.

Figure 1:
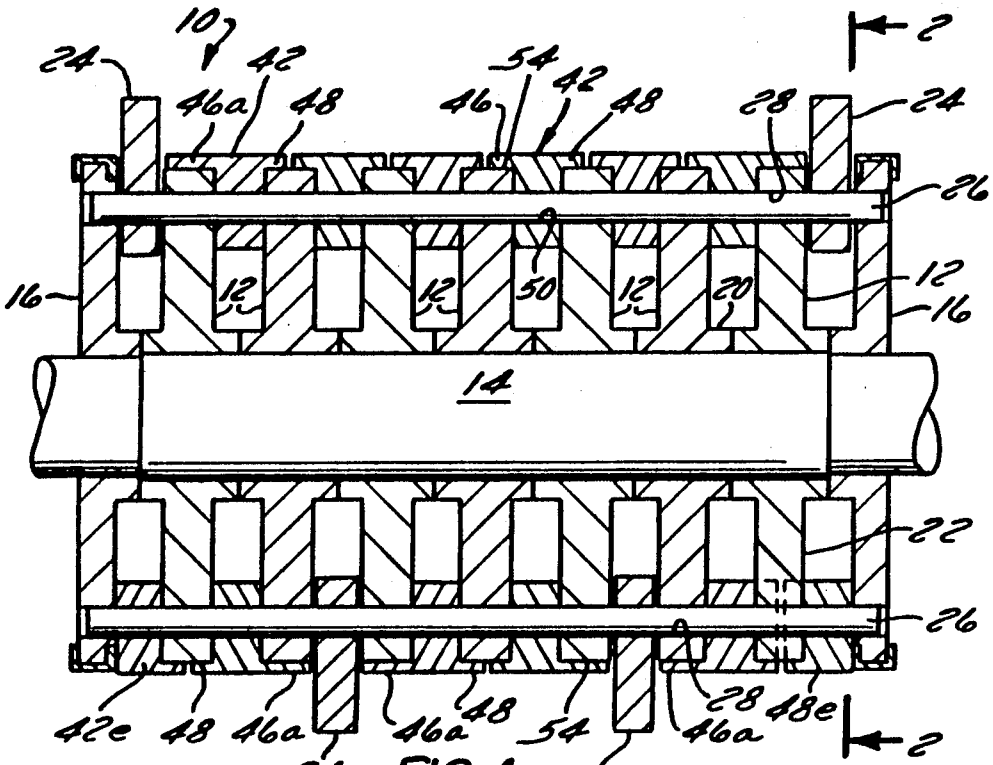
FIG. 1 is a section view through the hammermill rotor.
Figure 3:
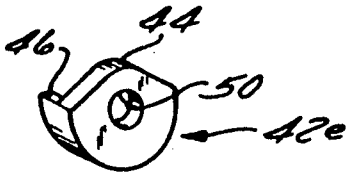
FIG. 3 is a perspective view of one of the caps having a flange on one side.

Referring to FIG. 1, it will be noted that when the cap 42 is mounted on the hammer shaft 26 in the space between the spider arms, the flanges 46 and 48 will generally extend part way across the surface of the tip 54. The flanges 46 and 48 on end caps 42 which are mounted in the spaces between the adjacent spider arms also extend partly across the face of the tip 54 to completely protect the tip from exposure to the flying fragments. The end caps 42 which are positioned adjacent to a hammer 24 are provided with an extended flange **46*a* on one side and an extended flange 48*a* on the other side in order to completely cover the tip 54** of the spider arm.

It should be noted that each of the end caps 42 is symmetrical in configuration and when worn on one side can be turned around so that the other side will protect the impact area at the end of the spider arm. The symmetrical type cap also allows the hammermill assembly to be used in reversible type shredders. The cap also serves to protect the exposed hammer shaft and therefore prevent damage to the hammer shaft from flying fragments. Although a six arm spider is shown in the drawings, the cap is capable of being used with spiders having two or more spider arm configurations.

It should be apparent that there has been provided in accordance with the invention a symmetrical protective end cap that fully satisfies the aims and advantages set forth above. While the invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

The embodiments of the invention in which an exclusive property or privilege is claimed are defined as follows:

1. For use in a rotary hammermill assembly having a plurality of spiders mounted adjacent each other on a drive shaft, each of the spiders having a number of radially extending arms, the arms of the spiders each having an outer surface terminating in a tip and being spaced from the arms of the adjacent spiders, a number of hammer shafts extending through the arms of the spiders and a number of hammers mounted on the hammer shafts between the spider arms, an end cap comprising a body portion adapted to be mounted on a hammer shaft to fill the space between the arms, and a circular flange adapted to overlie the adjacent tips of the spider arms to define a protective surface only for the outer surface and the tip of said spider arm and said hammer shaft whereby the tip of the spider arm and the space between the spider arms are protected from flying fragments of shredded metal.

2. The cap according to claim 1 wherein said flange is sized to extend over a portion of the tip of the spider arms whereby adjacent caps provide continuous protection for the tips of the spider arms.

3. The cap according to claim 1 wherein said cap is symmetrical whereby said hammermill assembly can be rotated in either direction.

4. The cap according ot claim 1 wherein teh tips of the spider arms have a reduced diameter and said flange has a corresponding internal diameter whereby said flange forms a continuation of the outer surface of the spider arms.

5. The end cap according to claim 1 wherein said end cap is formed of a steel which is harder than a steel used to form the spider arms.

6. A rotary hammermill assembly for a hammermill having a drive shaft, said assembly comprising a number of spider assemblies mounted adjacent each other on the drive shaft, each spider assembly including a spider having a number of arms, said arms each having an outer surface terminating in a tip and including an opening and being aligned in rows, a hub on each side to provide a hammer space between said arms, a hammer shaft aligned in said openings in each row of arms and having an exposed portion, a number of hammers mounted on said hammer shafts and an end cap mounted on each exposed portion of said hammber shaft to protect the tips of said spider arms, each cap including a body portion filling the space between said arms and flange means covering a portion of the tip of each spider arm, said cap being symmetrical and reversible whereby said hammermill assembly is rotatable in either direction.

7. The assembly according to claim 6 wherein the tip of each of said arms has a diameter less than the outer surface of each of said arms, and said flange means includes a flange on at least one side of said body portion to protect the outer surface of the adjacent spider arms.

8. The assembly according to claim 7 wherein each said flange forms a continuation of the outer surfaces of each said spider arm.

* * * * *